US006547459B2

(12) United States Patent
Earle et al.

(10) Patent No.: US 6,547,459 B2
(45) Date of Patent: Apr. 15, 2003

(54) PROCESSING APPARATUS

(75) Inventors: Anthony Earle, Harrow Weald (GB); John F. Daehne, Watford (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/025,405

(22) Filed: Dec. 19, 2001

(65) Prior Publication Data

US 2002/0127015 A1 Sep. 12, 2002

(30) Foreign Application Priority Data

Dec. 21, 2000 (GB) ..... 0031180

(51) Int. Cl.[7] ..... G03D 3/02; G03D 3/04; G03D 3/08

(52) U.S. Cl. ..... 396/612; 396/626; 396/634; 396/636

(58) Field of Search ..... 396/633–636, 396/585, 599, 612

(56) References Cited

U.S. PATENT DOCUMENTS

| | | | |
|---|---|---|---|
| 4,269,501 | A | 5/1981 | Griffith et al. |
| 4,277,159 | A | 7/1981 | Descotes |
| 4,444,480 | A | 4/1984 | Freeman |

FOREIGN PATENT DOCUMENTS

| | | |
|---|---|---|
| NL | 113444 | 12/1966 |

*Primary Examiner*—D Rutledge
(74) *Attorney, Agent, or Firm*—Frank Pincelli

(57) ABSTRACT

A drum chamber in which photographic material is processed is provided with a section in which the walls overlap to form a narrow channel therebetween. The channel acts as the entrance to and exit from the chamber for the material being processed.

4 Claims, 2 Drawing Sheets

PROCESSING APPARATUS

FIELD OF THE INVENTION

This invention relates to an apparatus for processing photographic material. In particular, the invention relates to processing which uses a low volume of processing solution.

BACKGROUND OF THE INVENTION

Conventional processing of photographic material requires the use of large tanks of processing solutions. Each tank contains a processing solution such as developer, bleach, fixing solution or washing solution. The material is transported through each tank in turn. There is a tendency for the solutions to carry over from one tank to another leading to pollution of the solutions. Conventional processing has several other drawbacks. The temperatures which can be utilised are limited and therefore the process is slow. The composition of the solutions must be stable over long time residence periods in the processing tanks. Replenishment of the solutions is difficult to control. The processing apparatus is also very large due to the number of processing tanks and the apparatus is limited to only one type of process.

To overcome the problems of conventional deep tank processing surface application of the processing chemicals was developed. In previous surface application methods a volume of solution is applied to the surface of the material being processed. However, previous surface application methods have several drawbacks. If the solution applied to the material is just left on the sensitised surface of the material in a static condition the processing will be very slow and inefficient because there is no agitation and by-products accumulate in the material and solution layers, slowing down the processing. This method is also prone to non-uniformity of processing.

It is also known to process the material within a rotary tube. The material to be processed is placed emulsion side facing inwards within the tube. Solution is added and the tube rotated. Large volumes of processing solution (70 ml/sq.ft and upwards) will process the material effectively so long as rotation is not so fast as to cause dispersion of the solution puddle. Rapid rotation of the device is however very desirable to quickly and evenly distribute a given small volume of solution over the whole surface of the material so that processing is uniform from one end to the other. If the rotation is too slow there will be seasoning of the small volume of solution by the front end of the material and processing will be different at the back end of the material. Small volumes of processing solution (50 ml/sq.ft or less) do not properly process film or paper because when the device is rotated, even at low speeds of rotation, the solution puddle is dispersed and spread over the whole surface of the material. Consequently there is no agitation. This leads to several processing defects. Processing is similar to that already described and can be streaky, non-uniform and slow because of local consumption and the production of by-products. There is no surface mixing and chemical economy is therefore low.

Co-pending application GB 0023091.2 discloses a processor having a cylindrical chamber which is rotated during processing. Film is loaded around the inner circumference of the chamber when the chamber is stationary. One method of loading film into the chamber of the processor is to provide an entry slot in the outer circumference and feed the film through the slot and round the inner circumference. The film is driven by a pair of rollers just outside the entry slot. This method has been described in the above mentioned co-pending application, in which edge guides are also provided to keep the film against the inner circumference and prevent it falling into the centre of the chamber. The edge guides overlap the film edges on both sides by about 2 mm thus providing film retention and also free access of processing solution to the image area and back of the film.

Co-pending application U.S. Ser. No. 09/920,495 (Processing Photographic Material, filed on Aug. 1, 2001, in the name of Twist, Earle, Wildman and Wells) discloses a processor having a cylindrical chamber which is rotated during processing. Film is loaded around the inner circumference of the chamber when the chamber is stationary. One method of loading film into the chamber of the processor is to provide an entry slot in the outer circumference and feed the film through the slot and round the inner circumference. The film is driven by a pair of rollers just outside the entry slot. This method has been described in the above mentioned co-pending application, in which edge guides are also provided to keep the film against the inner circumference and prevent it falling into the centre of the chamber. The edge guides overlap the film edges on both sides by about 2 mm thus providing film retention and also free access of processing solution to the image area and back of the film.

At present the film is fed into the drum chamber through a slot in the outer wall. To seal this and to prevent the solution escaping a rubber door has been used which is opened and closed by a mechanical linkage operated by an electrical solenoid, see FIGS. 1 and 2A and 2B. This system is quite complex and requires a lot of maintenance. In practice the door is worn away very quickly by the film. The door also has been found to leak. The return springs for the linkage also corrode and fail.

The present invention aims to overcome the above mentioned problems.

SUMMARY OF THE INVENTION

According to the present invention there is provided an apparatus for processing photographic material, comprising a chamber adapted to hold the photographic material therein, means for introducing processing solution into the chamber, means for removing processing solution from the chamber and means for rotating the chamber, wherein the wall of the chamber has a first end and a second end configured such that the chamber has a substantially circular cross-section, the first end and the second end overlapping by a length sufficient to retain the solution within the chamber during rotation thereof and leaving a narrow channel therebetween, the channel acting as the entrance and the exit for the photographic material.

A processor according to the invention prevents substantially all leakage of solution. This is very important when dealing with the low volumes associated with this type of processor.

As there is no complex mechanical mechanism manufacturing costs are reduced. By reducing the number of parts to the processor the manufacture thereof is simplified, as is the software and operation of the processor.

BRIEF DESCRIPTION OF THE DRAWINGS

The invention will now be described, by way of example, with reference to the accompanying drawings, in which.

DETAILED DESCRIPTION OF THE INVENTION

Figure 1:
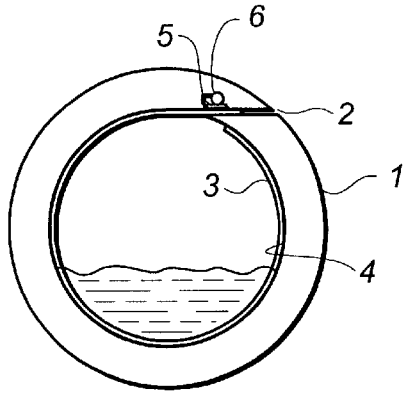
FIG. 1 (PRIOR ART)
FIGS. 1, 2A and 2B illustrate a known entry slot of a processor.
Figure 2A:
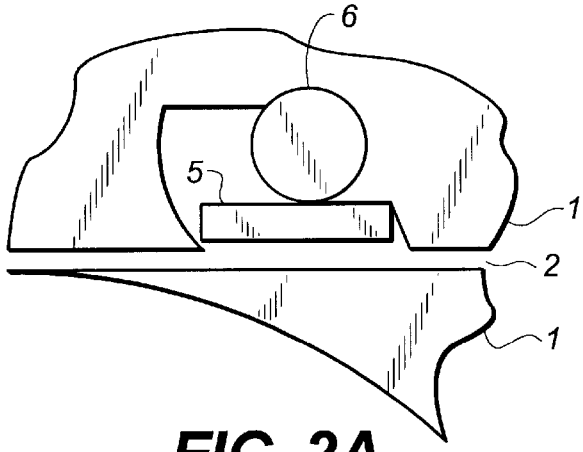
FIG. 2A (PRIOR ART)
Figure 2B:
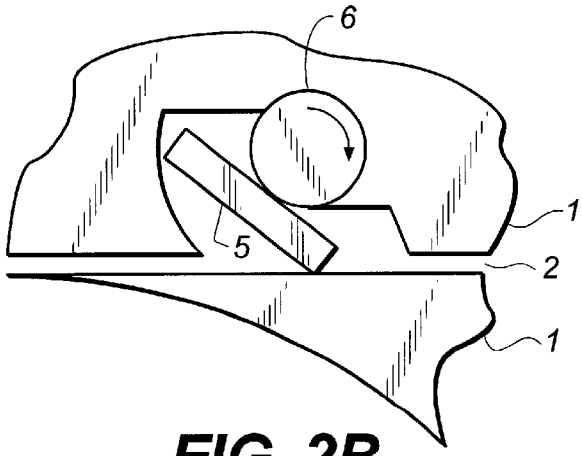
FIG. 2B (PRIOR ART)

FIGS. 1, 2A and 2B show a processor having an known entry slot.

The processor comprises a cylinder 1 having an open side or end and a closed side or end. The cylinder may be made of stainless steel, plastics or any other suitable material. The cylinder defines a processing drum chamber 4. A slot 2 is provided through the wall of the cylinder to allow a strip of film 3 to be loaded into the drum chamber 4. The slot is provided with a rubber member 5 which can be moved from an open position allowing film entry into the drum chamber and a closed position. The rubber member 5 is moved by the rotation of axle 6 in a known manner. A pair of pinch rollers (not shown) are provided at the entry to the slot 2. A drive shaft is provided at the closed side or end of the cylinder 1 for rotation thereof. The open end of the cylinder is provided with a flange. The flange retains solution within the processing chamber. Processing solutions may be introduced into and removed from the chamber by any suitable means.

An agitation roller may be provided in the lower part of the chamber 4. In order to simplify the drawings the roller is not shown in FIG. 1. In operation the film 3 is loaded through the entry slot 2 by the pinch rollers while the drum 4 is stationary. The film is fed into the processing chamber 4 with the emulsion side facing inwards. As the film is fed into the chamber it passes under the agitation roller. The film is passed in until the end of the film 3 is reached when it is held by the pinch rollers. Processing solutions are then added and removed as required in order to process the film. Full details of the method of processing can be found in co-pending application no GB 0023091.2, the contents of which are herein incorporated.

Figure 3:
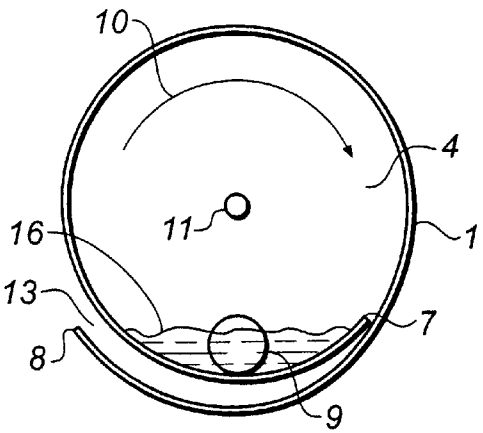
FIG. 3 is a schematic view of a processor having an entry slot according to the invention.

FIG. 3 illustrates schematically a processor as described above but having an entry slot according to the invention. The agitation roller 9 is shown in this figure.

As described above the cylinder 1 is mounted on a rotating drive axle 11. The wall of the drum chamber 4 is configured such that it has a substantially circular cross section and an overlapping section between the two ends of the wall. The length of overlap required for the invention to work is determined by various parameters, as described later. A narrow channel or slot 13 is formed by the overlap of the two ends of the wall. The channel is configured such that there is no perceptible hump for the roller to pass over as the chamber rotates. This ensures smooth running of the drum chamber and uniformity of processing. The entry slot or channel 13 allows the film to pass from the outside of the drum chamber to lay against the inner circumference thereof. It can be seen in FIG. 3 that a puddle of the processing solution 16 lies at the bottom of the drum chamber. The solution is prevented from leaving the chamber via the entry slot 13 due to the first or innermost end of the cylinder wall 7. The second or outermost end of the cylinder wall 8 is higher than the level of the level of solution 16 at this stage.

Figure 5:
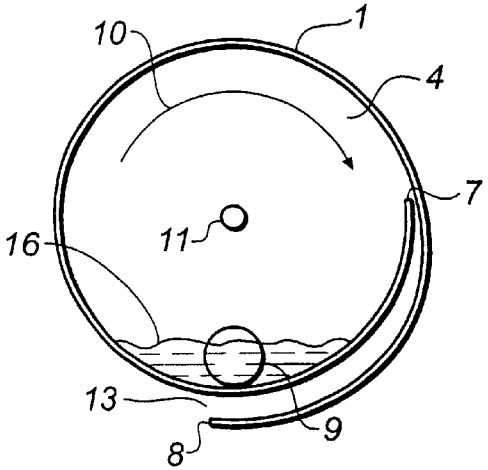
FIGS. 4 and 5 show the behaviour of the processing solution as the processor is rotated.
Figure 4:
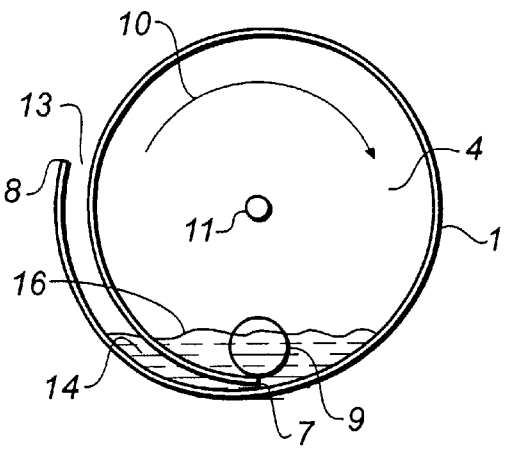

FIGS. 4 and 5 show the behaviour of the processing solution as the processor is rotated.

In operation the drum chamber is rotated in the direction of arrow 10. The solution 16, which is normally added after the film, runs down over the end of the cylinder wall 7 and is caught in the lower convolution at position 14. The solution is prevented from running out of the drum chamber 4 because the end of the cylinder wall 8 has travelled up and is well clear of the solution. The drum chamber continues to rotate, as shown in FIG. 5. The outermost end of the cylinder wall 8 now passes downwards and is lower than the level of the solution 16. However, the solution is held in the drum chamber because the innermost end of the cylinder wall 7 is now well above the solution level. The drum has completed a revolution when it has returned to the position shown in FIG. 3. Whilst the drum chamber rotates in this direction the processing solution is retained therein without leaks or drips. Its not necessary for the speed of rotation to be constant during the process. The speed can vary if required by the process. The solution can be removed from the drum chamber 4 by pumping or by reversing the direction of rotation of the drum chamber.

The length of the overlap between the innermost end of the cylinder wall 7 and the outermost end of the cylinder wall 8 is determined by the speed of the drum rotation, the viscosity of the processing solution and diameter of the drum chamber. Table 1 show typical lengths for a drum diameter of 19 inches (48.3 cm) with water at different revolutions per minute.

TABLE 1

| RPM | LENGTH | (inches and cm) |
|---|---|---|
| 15 | 5 | 12.7 |
| 30 | 3 | 7.6 |
| 60 | 3.5 | 8.9 |

These are typical results and it will be understood that the actual length of overlap is dependent on the above mentioned parameters.

The invention has been described in detail with reference to certain preferred embodiments thereof. It will be understood by those skilled in the art that variations and modifications can be effected within the scope of the invention.

| PARTS LIST | |
|---|---|
| 1 | cylinder |
| 2 | slot |
| 3 | film |
| 4 | drum chamber |
| 5 | member |
| 6 | axle |
| 7 | innermost end of cylinder wall |
| 8 | outermost end of cylinder wall |
| 9 | roller |
| 11 | axle |
| 13 | slot |
| 16 | solution |

What is claimed is:

1. An apparatus for processing photographic material, comprising a rotatable chamber adapted to hold the photographic material therein, wherein the wall of the chamber has a first end and a second end configured such that the chamber has a substantially circular cross-section, the first end and the second end overlapping by a length sufficient to retain the solution within the chamber during rotation thereof and leaving a narrow channel therebetween, the channel acting as the entrance and the exit for the photographic material.

2. An apparatus as claimed in claim 1 wherein the length of overlap is between 0.01 to 0.5 times the diameter of the chamber.

3. An apparatus as claimed in claim 1 including means for sweeping the surface of the material at each rotation of the chamber.

4. An apparatus as claimed in claim 3 wherein the wall of the chamber and the channel are so configured that there is a smooth transition for the sweeping means as it crosses the first end of the wall of the chamber.

* * * * *